US005148671A

United States Patent [19]

Kast et al.

[11] Patent Number: 5,148,671

[45] Date of Patent: Sep. 22, 1992

[54] FUEL CIRCULATION CONTROL SYSTEM

[75] Inventors: Kevin H. Kast, Cincinnati; William J. Myers, Jr., West Chester, both of Ohio

[73] Assignee: General Electric Company, Cincinnati, Ohio

[21] Appl. No.: 599,211

[22] Filed: Oct. 17, 1990

[51] Int. Cl.[5] ..... F02C 9/28

[52] U.S. Cl. ..... 60/39.281; 60/734

[58] Field of Search ..... 60/39.281, 734, 739, 60/740, 741, 261

[56] References Cited

U.S. PATENT DOCUMENTS

| | | | |
|---|---|---|---|
| 4,128,995 | 12/1978 | Toot | 60/39.281 |
| 4,171,613 | 10/1979 | Schmidt-Roedenbeck | 60/39.281 |
| 4,802,334 | 2/1989 | Eder et al. | 60/261 |
| 4,922,710 | 5/1990 | Rowen et al. | 60/39.281 |
| 5,022,224 | 6/1991 | Smith | 60/39.281 |

*Primary Examiner*—Louis J. Casaregola

*Attorney, Agent, or Firm*—Bernard E. Shay; Jerome C. Squillaro

[57] ABSTRACT

A control circuit adapted to receive at least first, second and third input signals. The first input signal is a signal representative of the fuel pressure at the output of a pump. The second signal is a signal representative of the fuel pressure in the manifold of fuel disbursement means which is supplied through a controllable valve, by the fuel pump. The third signal is a signal representative of the pressure at the inlet to the pump. The control circuit further includes a feedback path for continuously circulating fuel from the manifold to the pump inlet. In one arrangement of the fuel supply system, there is an aperture in parallel with the controllable valve and an aperture in the feedback path.

8 Claims, 4 Drawing Sheets

FUEL CIRCULATION CONTROL SYSTEM

The U.S. Government has rights in this invention pursuant to contract no. F33657-83-C-0281 awarded by the Department of the Air Force.

The present invention relates, in general, to systems for controlling the flow of fuel through augmentors and fuel nozzles and, more particularly, to an apparatus and method for controlling the flow of fuel in a fuel system adapted to ensure continuous flow.

BACKGROUND OF THE INVENTION

In augmentor systems (also known as afterburners) fuel is not used on a continuous basis. However, in order to ensure acceptable response times, it is desirable that fuel be available at the augmentor nozzle when the augmentor is activated. Unfortunately, the temperatures of the augmentor manifold are normally high enough to vaporize stagnant fuel. Thus, stagnent fuel in the augmentor manifold tends to vaporize when the augmentor nozzles are closed. When fuel vaporizes it tends to leave carbon deposits which may block the augmentor nozzles. These carbon deposits are known as coking.

When an augmentor's nozzles are opened and fuel flows, the augmentor is said to be in the "active" mode. When the nozzles are closed, the augmentor is said to be in the "dry" mode. One method of preventing evaporation is to circulate fuel through the augmentor manifold during "dry" periods. Since the circulating fuel does not evaporate, coking does not occur.

It will be recognized that the technique of circulating fuel may be used in any high temperature environment, for example, in combustors, to prevent evaporation and carbon buildup. Thus, for the purpose of the present application, the term fuel disbursement means will be used to describe apparatus such as augmentors and combustors which disburse fuel into a region such as an exhaust nozzle or combustion chamber.

In a fuel flow apparatus in which fuel is continuously circulated through the manifold of a fuel disbursement means, it would be advantageous to provide a means for accurately controlling the flow of fuel to the fuel disbursement means. More particularly, it would be advantageous to provide a fuel disbursement control system designed to account for the continuous circulation of fuel and adjust the valve supplying fuel to the disbursement means to compensate for the continuously circulated fuel.

SUMMARY OF THE INVENTION

A control circuit adapted to receive at least first, second and third input signals. In one embodiment, the first input signal is a signal representative of the fuel pressure at the output of a pump. The second signal is a signal representative of the fuel pressure in the manifold of fuel disbursement means which is supplied through a controllable valve, by the fuel pump. The third signal is a signal representative of the pressure at the inlet to the pump. The control circuit further includes a feedback path for continuously circulating fuel from the manifold to the pump inlet. In one arrangement of the fuel supply system there is an aperture in parallel with the controllable valve and an aperture in the feedback path.

In a control circuit according to the present invention, the first and second signals are summed to obtain a signal representative of their difference. A signal representative of the square root of that difference is then generated. A signal representative of the product of the signal representative of the square root and a signal proportional to a signal representative of the flow coefficient of the aperture in parallel with the controllable valve is generated to obtain a signal representative of the flow through the first aperture.

Further, in a control circuit according to the present invention, the second and third signals are summed to obtain a signal representative of the difference. A signal representative of the square root of that difference is then generated. A signal representative of the product of the signal representative of the square root and a signal proportional to a signal representative of the flow coefficient of the aperture in the feedback path between the manifold and the pump is calculated to obtain a signal representative of the fuel flow through the aperture between the manifold and the pump.

The signal representative of the flow through the first aperture may then be subtracted from the sum of the signal representative of the flow through the second aperture and the total fuel flow demand. The resulting signal may then be subtracted form a signal representative of the flow through the controllable valve to provide a signal useful for adjusting the controllable valve.

BRIEF DESCRIPTION OF THE DRAWINGS

The novel features of the invention are set forth with particularity in the appended claims. The invention itself, however, both as to organization and method of operation, together with further objects and advantages thereof, may best be understood by reference to the following description taken in conjunction with the accompanying drawings in which:

DETAILED DESCRIPTION OF THE INVENTION

Figure 1:
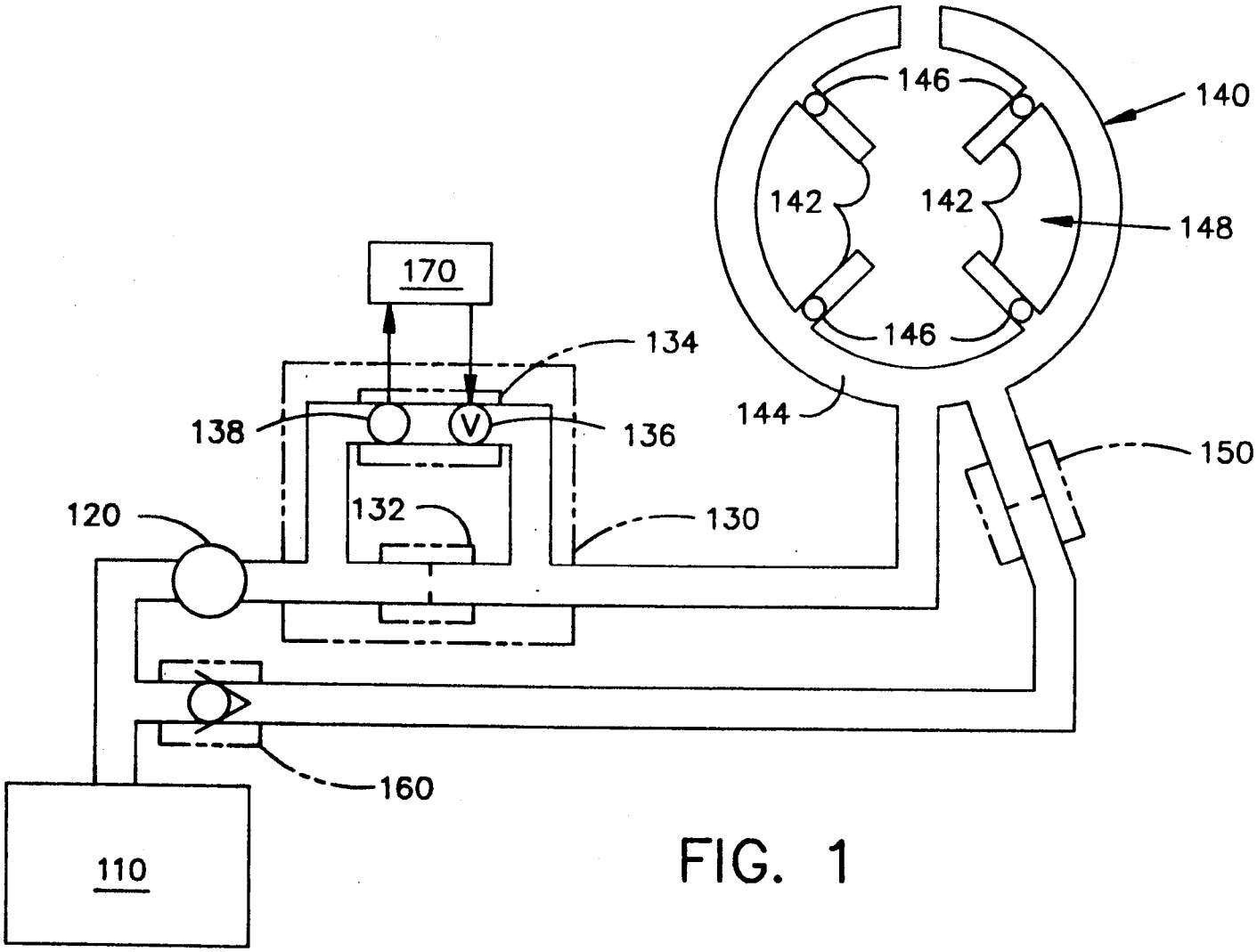
FIG. 1 illustrates a fuel supply system.

FIG. 1 illustrates a fuel circulation system. In FIG. 1, main fuel pump 120 pumps fuel from fuel supply 110 to a fuel disbursement means 140 (e.g., an augmentor or combustor) through flow control means 130 which is controlled by logic 170. Unused fuel is returned to the system through restrictor means 150 and check valve 160. Fuel control means 130 in FIG. 1 includes a first restrictor means 132, such as an aperture, in parallel with a controllable valve 134. Fuel flowing to fuel disbursement means 140 through fuel control means 130 is divided between controllable valve 134 and restrictor means 132. Fuel flows continuously through restrictor means 132, regardless of the position of controllable valve 134. The fuel system in FIG. 1 is adapted to circulate fuel continuously from fuel manifold 144 to the inlet of pump 120 through second restrictor means 150 and a check valve 160. Flow through controllable valve 134 is adjusted by opening or closing adjustable valve 136 according to the signal from feedback means 138 and logic 170.

Figure 2:
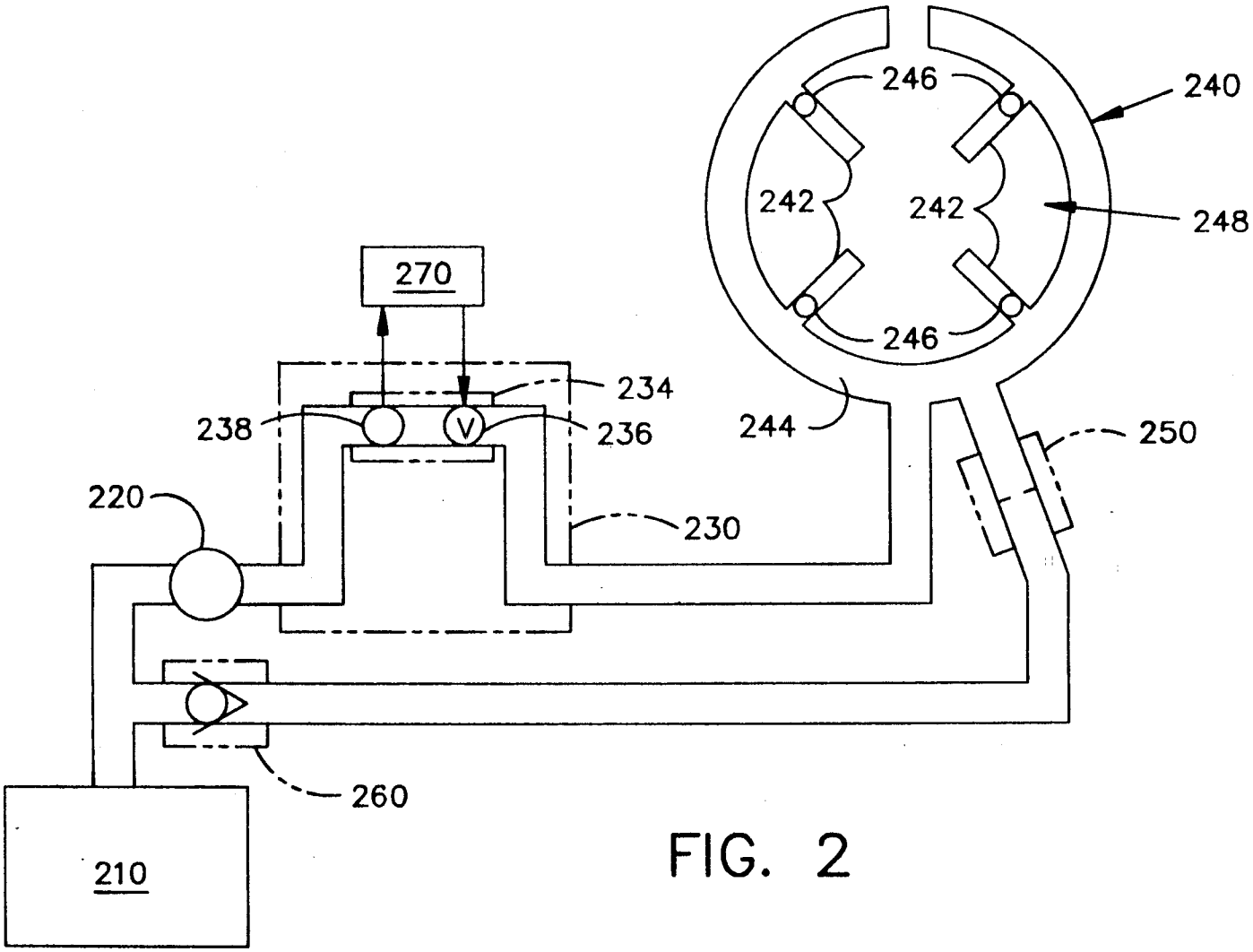
FIG. 2 illustrates an alternative fuel supply system.

FIG. 2 illustrates an alternative embodiment of the invention illustrated in FIG. 1. In FIG. 2, adjustable valve 234 does not close completely. When adjustable valve 234 is closed, a small apperture remains (e.g., a hole in the valve plate or a stop) which allows a small amount of fuel to continue to flow. Thus, fuel flows continuously through control valve 234 and restrictor means 250. In FIGS. 1 and 2, like elements are identified by like second and third digits of the reference number (e.g., pump 120 in FIG. 1 is substantially identical to pump 220 in FIG. 2). The first digit of the reference number identifies the figure number in which the element may be found. Like elements in FIGS. 1 and 2 are intended to be substantially identical in structure and function.

A more detailed explanation of the circulation systems illustrated in FIGS. 1 and 2 may be found in concurrently filled, co-pending application titled "Continuous Flow Fuel Circulation System" U.S. Ser. No. 599,171, filed Oct. 17, 1990, assigned to the assignee of the present application, which is hereby incorporated by reference.

Figure 3:
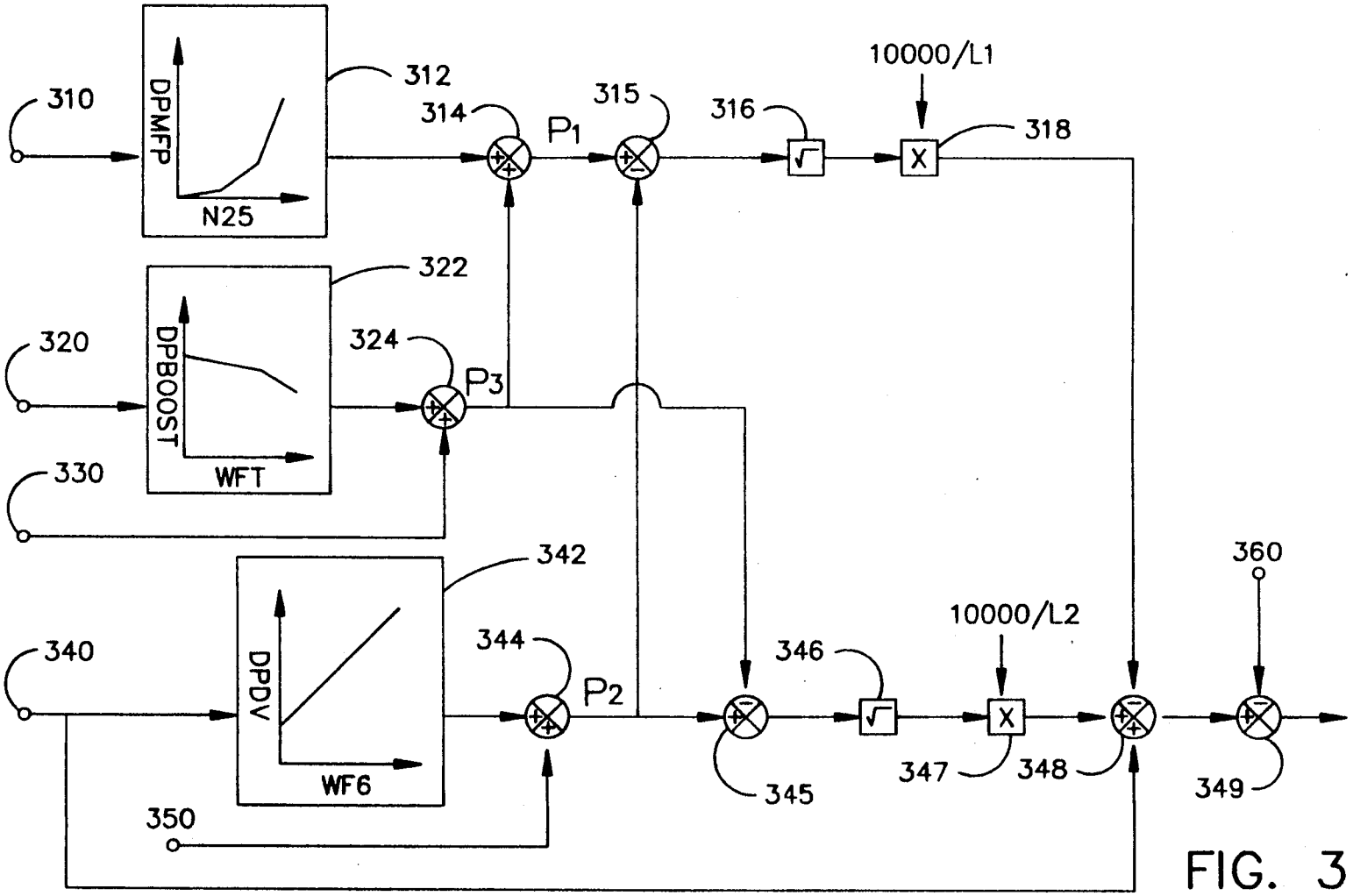
FIG. 3 illustrates an embodiment of a control system according to the present invention.

FIG. 3 illustrates one embodiment of control logic 170 of FIG. 1 according to the present invention. The logic illustrated in FIG. 3 controls the flow of fuel through control valve 134. In the active mode, fuel is pumped through controllable valve 134 to fuel disbursement means 140 and through pressure actuated valve 146 and nozzles 142 into chamber 148 where it is ignited. Since flow control means 130 includes restrictor means 132, a certain amount of fuel will bypass controllable valve 134. Further, since the fuel supply system of FIG. 1 includes restrictor means 150, a certain amount of fuel will bypass disbursement means 140 and be returned to the input of pump 120.

In order to accurately control the amount of fuel passing through nozzles 142, it is necessary to account for the fuel passing through restrictor 132 and restrictor 150 when fuel disbursement means 140 is in the active mode. Thus, since controllable valve 134 controls the amount of fuel supplied to disbursement means 140, control logic 170 must be designed to account for the fuel flowing through restrictor means 132 and restrictor means 150.

The fuel flow through the system of FIG. 1 may be calculated by:

$$WFM = WFE + \frac{10{,}000\sqrt{(P_2 - P_3)*SG}}{L_2} - \frac{10{,}000\sqrt{(P_1 - P_2)*SG}}{L_1}$$

where:

WFM is the flow through controllable valve 134.

$P_1$ is the discharge fuel pressure at the outlet of fuel pump 120.

$P_2$ is the fuel pressure in manifold 144 of fuel disbursement means 140.

$P_3$ is the pressure at the inlet of fuel pump 120.

$L_1$ is the flow coefficient of restrictor means 132.

$L_2$ is the flow coefficient of restrictor means 150.

SG is the specific gravity of the fuel.

WFE is the demanded flow through nozzles 142 (i.e., the desired flow).

In one embodiment of the present invention, illustrated in FIG. 3, a first pressure signal (P1) representative of the pressure at the outlet of fuel pump 120 is input to an input of first summing means 315. A second signal representative of the pressure ($P_2$) in manifold 144 of fuel disbursement means 140 is input to a second input of first summing means 315. The output of first summing means 315 is a signal representative of the difference between the two input signals. The output of first summing means 315 is routed to the input of first transfer function means 316. The output of first transfer function means 316 is a signal representative of the square root of the input. The output of first transfer function means 316 is routed to one input of first multiplier means 316 is routed to one input of first multiplier means 318.

The second input of first multiplier means 318 is a signal representative of a constant value which is proportional to the flow coefficient of first restrictor means 132. For example, the constant may be equal to approximately:

$$\frac{10{,}000}{L_1}$$

where $L_1$ is the flow coefficient of first restrictor means 132. The output of first multiplier 318 is a signal representative of the quantity of fuel flowing through first restrictor means 132.

In the embodiment of FIG. 3, the second pressure signal ($P_2$), representative of the pressure in manifold 144 (i.e., at the inlet to pressure actuated valves 146) is input to a first input of second summing means 345. A third pressure signal ($P_3$), representative of the pressure at the inlet to fuel pump 120 is input to a second input of second summing means 345. The output of second summing means 345 is a signal representative of the difference between the second and the third pressure signals. The output of second summing means 345 is connected to the input of second transfer function means 346. The output of second transfer function means 346 is approximately equal to the square root of the input. The output of second transfer function means 346 is connected to a first input of second multiplier means 347. A second input of second multiplier means 347 is a signal proportional to the flow coefficient of second restrictor means 150. For example, the signal at the second input of second multiplier means 347 may be equal to approximately:

$$\frac{10{,}000}{L_2}$$

where $L_2$ is the flow coefficient of second restrictor means 150. The output of second multiplier 347 is a signal representative of the quantity of fuel flowing through second restrictor means 150.

The output of first multiplier means 318 is summed with the output of the second multiplier means 347 in third summing means 348. Third summing means 348 further includes as an input a signal representative of the fuel flow demanded by fuel disbursement means 140. The output of third summing means 348 is a signal representative of the difference between the output of first multiplier means 318 and second multiplier means 347, added to a signal at input 340 which is representative of the fuel flow demanded by fuel disbursement means 140. Thus, the output of third summing means 348 is a signal representative of the amount of fuel which should be flowing through controllable valve 134.

The output signal from summing means 349 may be compared with a signal at input 360 from feedback means 138 which is representative of the actual amount of fuel flowing through controllable valve 134. These two signals may be compared in a known manner, such as by subtracting one from the other in seventh summing means 349, to obtain a signal representative of the necessary adjustments to adjustable valve 136. Thus, adjustable valve 136 may be adjusted to ensure sufficient flow through controllable valve 134, taking into account the flow through first restrictor means 132 and second restrictor means 150.

In the embodiment described above, the first ($P_1$), second ($P_2$) and third ($P_3$) pressure signals may be either measured or obtained by modelling or by some combination of measurement and modeling. In one embodiment of the present invention, the pressure at the outlet of pump 120 may be measured directly using, for example, a pressure transducer to provide a signal representative of the pressure at the outlet of pump 120. The pressure in manifold 144 could also be measured directly using, for example, a pressure transducer to provide a signal representative of the pressure in manifold 144. The pressure at the inlet to pump 120 could be measured directly using, for example, a pressure transducer to provide a signal representative of the pressure at the inlet to pump 120.

However, it is not always desirable to measure pressure directly when that information is available using other measured parameters and models of elements of the fuel system. If the pressures are not measured directly, the number of transducers and their associated wiring are reduced, which increases reliability. Therefore, in an alternate embodiment of the present invention, the first ($P_1$), second ($P_2$) and third ($P_3$) pressure signals are derived from a combination of measured parameters and models of system components.

In FIG. 3, the first pressure signal ($P_1$), which is representative of the pressure at the output of fuel pump 120 is the output of fourth summing means 314. The signal at the first input to fourth summing means 314 is the output of third transfer function means 312. The input to third transfer function means 312 is a signal at input 320 representative of the engine speed, such as, for example the engine core speed in a turbofan engine. Third transfer function means 312 includes a model of main fuel pump 120 and its associated driving gears such that an input signal (e.g., core speed) is matched to a correlating output signal representative of the modeled pressure differential across fuel pump 120. Thus, the output of the third transfer function means 312 is representative of the differential pressure across pump 120 for a specific input speed signal. The second input to fourth summing means 314 is a signal representative of the pressure at the inlet of pump means 120. Thus, the output of fourth summing means 314 is a signal which may be representative of the pressure at the outlet of pump 120. The output of fourth summing means 314 is input to first summing means 315.

In FIG. 3 the third pressure signal ($P_3$), which may be representative of the pressure at the inlet of fuel pump 120, is the output of fifth summing means 324. A first input to fifth summing means 324 is the output of fourth transfer function means 322 which is a signal representative of the pressure rise across the fuel supply means 110 which may include, for example, a boost pump. The input to fourth transfer function means 322 may be, for example, a signal at input 320 representative of the fuel flow out of source 110 which may be a measured or modeled parameter. Thus, for a particular fuel flow out of fuel supply means 110, the output of fourth transfer function means 322 is representative of the pressure rise in fuel supply means 110. A second input to fifth summing means 324 is a signal at input 330 representative of the ambient air pressure, this signal may be either derived or measure. The output of fifth summing means 324 is a signal representative of the pressure at the inlet to pump 120. The output of fifth summing means 324 is an input to second summing means 345.

The FIG. 3, the output of sixth summing means 344 is a signal representative of the pressure in manifold 144 of distribution means 140. A first input to sixth summing means 344 is the output of fifth transfer function means 342 which is a signal representative of the pressure drop across pressure actuated valves 146. The input to fifth transfer function means 342 may be, for example, a signal at input 340 representative of the fuel flow demanded by the augmentor or combustor. The signal at input 340 may be a modeled or measured parameter representative of the fuel demand in fuel disbursement means 140. Fifth transfer function means 342 may include a model representative of pressure actuated valves 146 such that a specific input signal will produce an output representative of the pressure drop across pressure actuated valve 146 for a particular fuel flow through pressure actuated valves 146. A second signal at input 350 which is connected to sixth summing means 344 is a signal representative of the pressure at the output of nozzels 142 (e.g., the engine augmentor duct pressure). This pressure may be either modeled or measured.

It will be recognized that the elements in FIG. 3 may be implemented hydromechanically, mechanically in software or by using specific electronic elements (e.g., digital or analog). For example, first, second, third, fourth, fifth, sixth and seventh summing means 315, 345, 348, 314, 324, 344 and 349 may be an analog operational amplifier circuits. First, second, third, fourth and fifth transfer function means 316, 346, 312, 322 and 342 may be, for example, lookup tables active networks such as analogue function generators or a mechanical cam. First and second multiplier means 318 and 347 may be, for example analog amplifier circuits. Preferably, each of these functions may also be implemented in software using known routines. The third, fourth and fifth transfer function means may be implemented in software using known look up table techniques with the lookup tables programmed according to the characteristics of the device (e.g., main pump) being modeled and the desired inputs.

Figure 4:
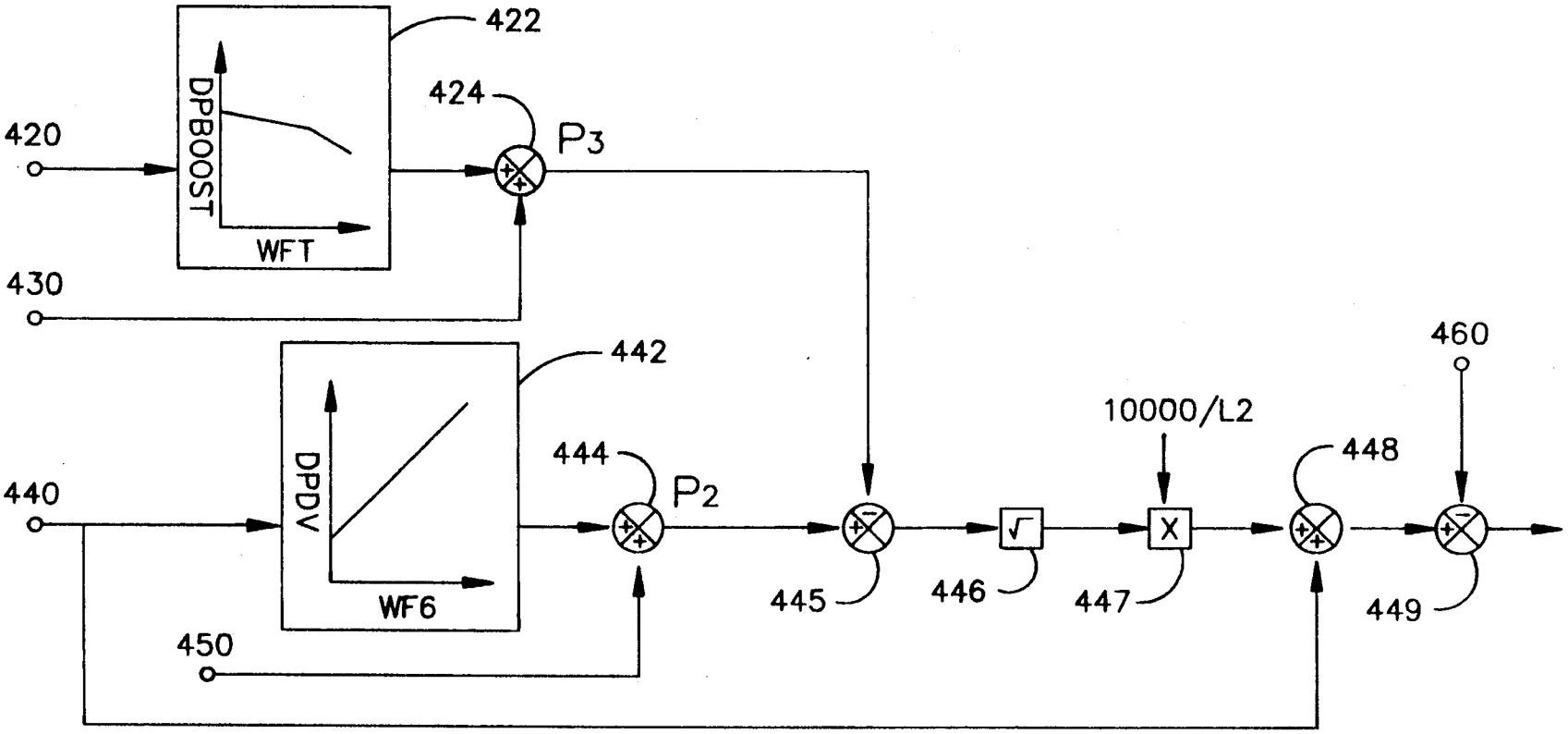
FIG. 4 illustrates a further embodiment of a control system according to the present invention.

FIG. 4 illustrates an embodiment of control logic 270 according to the present invention adapted to control to fuel system illustrated in FIG. 2. In FIG. 4, a second pressure signal ($P_2$) is summed with a third pressure signal ($P_3$) in second summing means 445 to form a signal representative of the difference between the second and third pressure signals at the output of the second summing means 445. The output of second summing means 445 is connected to second transfer function means 446. The output of second transfer function means 446 is a signal representative of the square root of the signal at the input of second transfer function means 446. The output of second transfer function means 446 is multiplied in multiplier means 447 by a constant which is approximately proportional to the flow coefficient of restrictor means 250. The output of multiplier means 447 is a signal proportional to the product of the inputs. The output of multiplier means 447 is summed in third summing means 448 with a signal at input 440 representative of total fuel demand in fuel distribution means 240.

It will be recognized that the second pressure signal ($P_2$) may be a signal representative of the pressure in manifold 244 which may be measured or calculated using the combination of fifth transfer function means 442 and sixth summing means 444 as described with respect to fifth transfer function means 344 and sixth summing means 342 in FIG. 3. The third pressure signal ($P_3$) may be a signal representative of the pressure at the inlet to pump 220 which may be measured or calculated using the combination of fourth transfer function means 422 and fifth summing means 424 as described with respect to fourth transfer function means 322 and fifth summing means 324 in FIG. 3.

In FIG. 4, elements having like second and third digits as elements in FIG. 3 are intended to have like operational characteristics (e.g., multiplier means 318 is intended to be substantially equivalent to multiplier means 416 in operation and structure). The first letters of the reference numbers are intended to identify the figure in which the element is located.

It will be apparent to those of skill in the art, that in the embodiment illustrated in FIG. 1, first restrictor means 132 may include a shutoff means (e.g., controllable valve) adapted to stop the flow of fuel through first restrictor means 132 when fuel is demanded by fuel disbursement means 140 (i.e., in the active mode), if first restrictor means 132 includes a shutoff means, then, with the shutoff means closed, it will function as illustrated in FIG. 2 since no fuel will flow through first restrictor means 132 when first restrictor means 132 includes a shutoff means, the logic illustrated in FIG. 4 may be used to adjust controllable valve 134 during the active mode.

It will be apparent to those of skill in the art that the term "summer means" as used herein is intended to encompass devices or program steps which either add or subtract the valves of the inputs to produce a sum or difference at the output.

It will be apparent to those of skill in the art that the "means" described herein are not necessarily limited to discrete devices and may include, for example, a general purpose computer or portions thereof adapted to perform the functions described in either hardware or software. Further, one or more of the "means" described herein may be combined into a single device or computer which performs the functions described. It will further be apparent to those of skill in the art that a number of discrete devices or computers may be used to perform the functions attributed to a single "means" in the present invention.

It will also be recognized that the first and second transfer function means 316, 346 and 446 may compensate for the specific gravity of the fuel by multiplying the input by a constant proportional to the specific gravity of the fuel prior to calculating the square root.

It will be recognized that the pressure drops through the lines and in components (e.g., the check valve) may be taken into account in any actual system. However, for the purposes of illustration and, in view of the fuel flow rates in this type of system, these pressure drops are considered to be negligible for the purposes of the present application.

While preferred embodiments of the present invention have been shown and described herein, it will be obvious to those skilled in the art that such embodiments are provided by way of example only. Numerous variations, changes, and substitutions will now occur to those skilled in the art without departing from the invention. Accordingly, it is intended that the invention be limited only by the spirit and scope of the appended claims.

What we claim is:

1. Control circuitry comprising:

first summing means for summing two input signals including first and second inputs and output, wherein said first input receives a first pressure signal and said second input receives a second pressure signal;

first transfer function means for converting an input signal to an output signal including an input connected to said output of said first summing means and an output;

first multiplier means for calculating a product, including a first and second inputs and an output, wherein said first input is connected to said output of said first transfer function means and said second input receives a first substantially constant input signal;

second summer means for summing two input signals including first and second inputs and an output, wherein said first input receives said second pressure signal and said second input receives a third pressure signal;

second transfer function means for converting an input signal to an output signal including an input and an output, wherein said input is connected to said output of said second summer means;

second multiplier means for calculating a product, including first and second inputs and an output, wherein said first input is connected to said output of said second transfer function logic means and said second input receives a second, substantially constant input signal;

third summer means for summing input signals including first, second and third inputs and an output, wherein said first input is connected to said output of said first multiplier means, said second input is connected to said output of said second multiplier means, said third input is connected to an external demand signal.

2. Control circuitry according to claim 1, further comprising:

a fourth summing means for summing two input signals having a first and second inputs and an output, wherein said first input is a signal representative of a pressure rise, said second input is said third pressure signal and said output is said first pressure signal;

a fifth summing means for summing input signals having a first and second input and an output, wherein said first input is a signal representative of a pressure, said second input is a signal representative of ambient pressure and said output is said third pressure;

a sixth summing means for summing input signals including first and second inputs and an output, wherein said first input is a signal representative of a pressure drop across a valve and said second input is a signal representative of pressure at an output of said valve.

3. Control circuitry according to claim 2 further comprising:

third transfer function means for converting an input signal to an output signal including an input and an output wherein said input is a signal representative of engine speed and said output is said signal representative of a pressure rise;

fourth transfer function means for converting an input signal to an output signal including an input and an output wherein said input is a signal representative of flow and said output is said signal representative of pressure; and fifth transfer function means for converting an input signal to an output signal including an input and an output wherein said input is connected to said external demand signal and said output is said signal representative of pressure drop across said valve.

4. Control circuitry according to claim 3 wherein:

said first and second transfer function means are adapted to output a signal representative of the square root of the input signal.

5. Control circuitry according to claim 1 wherein said control circuitry is incorporated in a fuel supply system including a main fuel pump and a fuel disbursement means including a manifold wherein:

said first pressure is a signal representative of a discharge pressure of a main fuel pump;

said second pressure is a signal representative of an inlet pressure of said main fuel pump; and said third pressure is a signal representative of a pressure in a manifold of a fuel disbursement means.

6. Control circuitry comprising:

first summer means for summing two input signals including first and second inputs and an output, wherein said first input receives a first pressure signal and said second input receives a second pressure signal;

first transfer function means for generating a square root for converting an input signal to an output signal including an input and an output, wherein said input is connected to said output of said first summer means;

first multiplier means for calculating a product, including first and second inputs and an output, wherein said first input is connected to said output of said first transfer function means and said second input receives a first substantially constant input signal;

second summer means for summing input signals including first and second inputs and an output, wherein said first input is connected to said output of said first multiplier means, said second input is connected to an external demand signal.

7. Control circuitry according to claim 6, further comprising:

a third summing means for summing input signals having a first and second input and an output, wherein said first input is a signal representative of an input pressure, said second input is a signal representative of ambient pressure and said output is said second pressure;

a fourth summing means for summing input signals including first and second inputs and an output, wherein said first input is a signal representative of a pressure drop across a valve and said second input is a signal representative of pressure at an output of said valve.

8. Control circuitry according to claim 7 further comprising:

second transfer function means for converting an input signal to an output signal including an input and an output wherein said input is a signal representative of flow and said output is a signal representative of pressure; and third transfer function means for converting an input signal to an output signal including an input and an output wherein said input is connected to a signal representative of fuel demand and said output is said signal representative of pressure drop across said valve.

* * * * *